United States Patent [19]

Russell

[11] 3,935,642

[45] Feb. 3, 1976

[54] DIRECTIONAL DRILLING OF BORE HOLES

[76] Inventor: Anthony William Russell, 3, Culross Close, Cheltenham, England

[22] Filed: Sept. 12, 1973

[21] Appl. No.: 396,634

Related U.S. Application Data

[63] Continuation of Ser. No. 197,416, Nov. 10, 1971, abandoned.

[30] Foreign Application Priority Data

Nov. 11, 1970 United Kingdom ..... 53552/70

[52] U.S. Cl. ..... 33/302; 33/312

[51] Int. Cl.[2] ..... E21B 47/022

[58] Field of Search ..... 33/312, 302

[56] References Cited

UNITED STATES PATENTS

| | | | |
|---|---|---|---|
| 3,407,508 | 10/1968 | Baskir | 33/312 |
| 3,587,175 | 6/1971 | Armistead | 33/312 X |
| 3,622,971 | 11/1971 | Arps | 33/302 X |
| 3,791,043 | 2/1974 | Russell | 33/312 |

*Primary Examiner*—William D. Martin, Jr.

*Attorney, Agent, or Firm*—George L. Church; Donald R. Johnson; John E. Holder

[57] ABSTRACT

For the directional drilling of boreholes, the orientation or roll angle of the drill head or mud-motor in the borehole has to be ascertained for steering purposes. The roll angle is determined, during drilling, by sensing at the location of the drilling tool in the borehole the values of the earth's magnetic field strength in two axes transverse to the main tool axis, signalling these values to the drilling station and translating them according to the direction and inclination of the borehole axis, which are known and normally updated at intervals between drilling runs. The down-hole assembly, located in a fixed attitude to the mud-motor, requires only static magnetic sensors. A resolver in a surface indicating unit provides for the indication of the roll angle as the angle determined by the sensors, translated according to the borehole information by the addition of an angle precalculated and selected from tables, calculated in a computation center, or calculated by computation in the indicating unit.

7 Claims, 15 Drawing Figures

DIRECTIONAL DRILLING OF BORE HOLES

This is a continuation of application Ser. No. 197,416, filed Nov. 10, 1971.

Field of the Invention

This invention relates to the directional drilling of boreholes and provides improved methods of and means for determining the orientation of a drill head in a borehole to facilitate steering of the drilling tool.

The invention is particularly but not solely applicable to deep drilling with a turbine-driven drilling tool known as a mud-motor which can be steered, to follow a desired path, provided that the existing path of the borehole is known and the orientation of the mud-motor can be ascertained. To provide information on the existing path of the borehole various methods of measuring the azimuth and pitch angles of the borehole are in use. In one such method, known as the single shot method, measurements of azimuth and pitch at the lower end of the borehole are taken during intervals between drilling runs.

STATEMENT OF THE PRIOR ART

Measurement of the orientation of the drill head in the borehole has in the past necessitated the inclusion, in the borehole probe of the instrument, of gravitational field sensors for the determination of the roll angle. For high angle holes, that is boreholes departing largely from the vertical so that the pitch angle is large, it is a practice to base the steering on a roll angle, measured with respect to a gravitational reference, the roll angle measurements being referred to a "high-side" readings. For low angle or near-vertical holes, on the other hand, steering is commonly based on readings of magnetic bearings in a gravitational coordinate system and directly or indirectly involving the high-side angle. It is an aim of the present invention to provide for continuous reading of the orientation during the actual drilling of a borehole whether it be of high angle or low angle, and without the need for gravitational field measurement during the drilling.

SUMMARY OF THE INVENTION

The invention in one aspect resides in a method of determining at a drilling station the orientation of a drill head in a borehole comprising the steps of sensing at the location of the tool in the borehole the earth's magnetic field strength components in two of three principal tool axes, the third fixed tool axis being the borehole axis, signalling the sensed field strengths to the drilling station and relating said sensed field strength components to the inclination and bearing of the lower end of the borehole.

In carrying out the invention the sensed components are translated according to the direction and inclination of the borehole axis. The translation is preferably effected by relating the sensed components to the earth's magnetic field components in principal axes rotated from magnetic north by the azimuth angle of the borehole axis and from the vertical by the pitch angle of the borehole axis.

The method involves the transfer of angles or vectors between two sets of axes, namely the fixed tool axes and fixed earth axes. Data for transferring the earth's magnetic field components at the drilling station to angularly rotated coordinates may be calculated and stored in graphs or tables, or otherwise, and selectively applied in the computation of the tool orientation from particular sets of sensed field strengths signalled to the drilling station. In this way, a particular computation becomes a simple matter and can be done by means of an electromechanical resolver or comparable device with an appropriately calculated or selected angle addition to its indicated angle reading.

The invention also resides in a method of steering a drilling tool in a borehole by remote control from a drilling station, wherein the drill head orientation is determined as described above and periodically or continuously indicated during a drilling run.

The invention also comprises means for determining the orientation of the drill head by the method set out above.

In one particular form the invention provides a measuring device comprising a borehole unit having two static sensors for measuring the magnetic field strength in two directions at right angles to each other and fixed in relation to the body of the unit, and means for transmitting the measurements to a surface indicator unit, the latter having signal processing circuits for deriving and displaying directional information and means for injecting into the processing circuits angle information based on the local values of the earth's magnetic field.

The invention provides steering parameters during the actual process of drilling, which parameters are derived only from magnetic sensors and available single shot measurements relating to the borehole. The need for gravity sensors in the orientation determining equipment is obviated.

A compass comprising static sensors fixed to the drill head to indicate remotely the bearing orientation of the tool when the tool is vertical, that is in a vertical borehole, will indicate, when the tool is inclined, a drill orientation in a different reference system. When the tool is vertical the reference system is defined by the three principal axes V, N and E. The magnetic datum direction is magnetic North at the geographical site and constitutes in effect the zero setting for an indicator or a protractor on a topographical chart. The primary tool axis is vertical and the tool orientation is the roll angle $\phi$ of each of the other two fixed tool axes in the horizontal plane and with respect to N and E respectively. When the tool is inclined the reference system has principal axes inclined respectively to V, N and E, one of these principal axes being still the primary tool axis and the measurements being made in the other two fixed tool axes but in terms of earth magnetic field components in the direction of those two axes, which components are not simply geometrically related to North and East magnetic field components. Complications thus arise that, because of the nonuniform patterns of the earth's magnetic field, inclination in the gravitational field, that is with respect to the vertical, involves change in magnetic field parameters, such change depending not only on the geographical site but also on the extent of the inclination. It will be shown that the measured orientation angle in the different reference system can nevertheless be translated into either a bearing orientation with respect to magnetic North (useful when the inclination is small), or an orientation about the tool and borehole axis measured as an angular deflection in a vertical plane, (i.e., the roll angle $\phi$, useful for high angle holes), that is, into a useful orientation angle in the V, N, E reference system by the simple introduction of a computed datum angle and hence by providing for a computed or precalibrated zero setting of the compass indicator.

DESCRIPTION OF PREFERRED EMBODIMENTS

Figure 1:
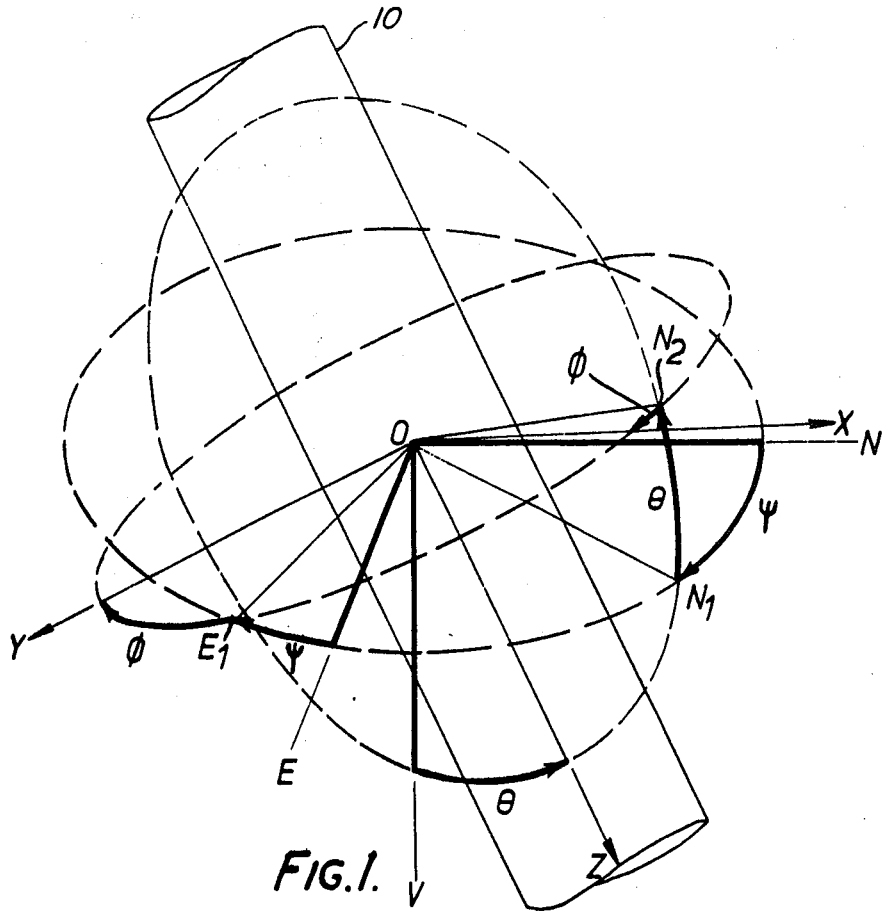
Figure 2:
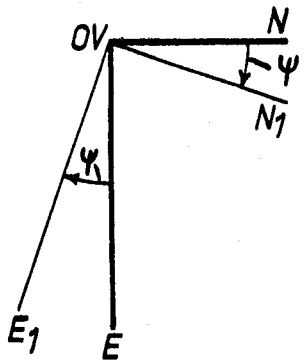
Figure 3:
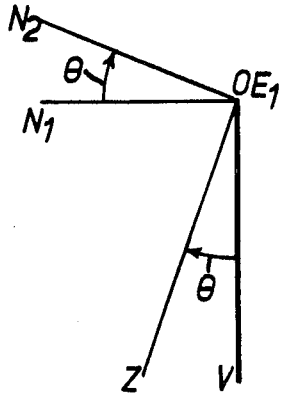
Figure 4:
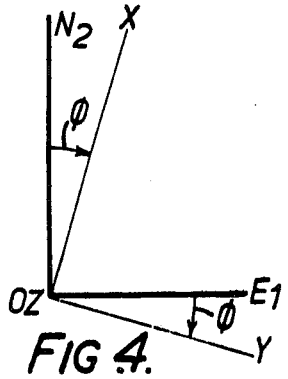
Figure 5:
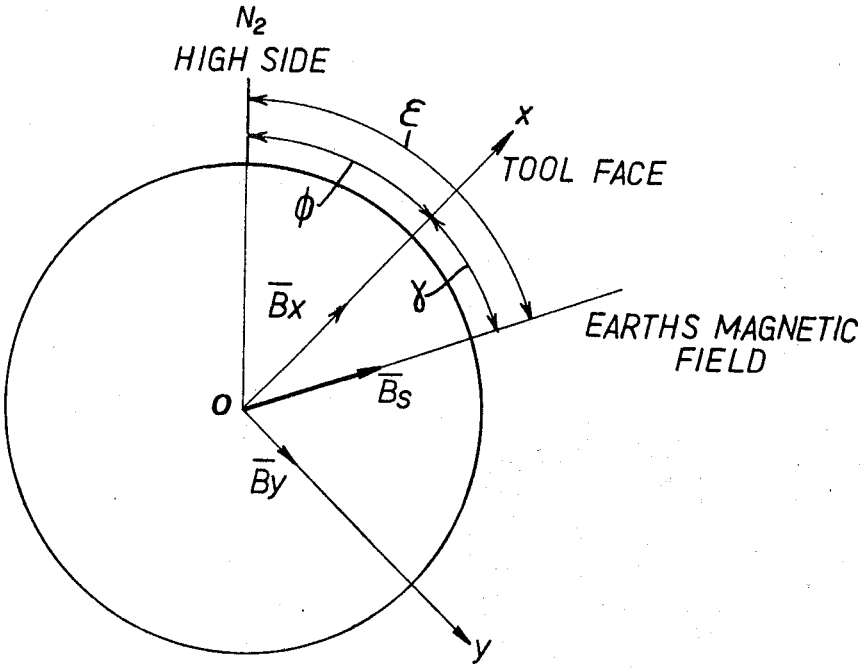
Figure 6:
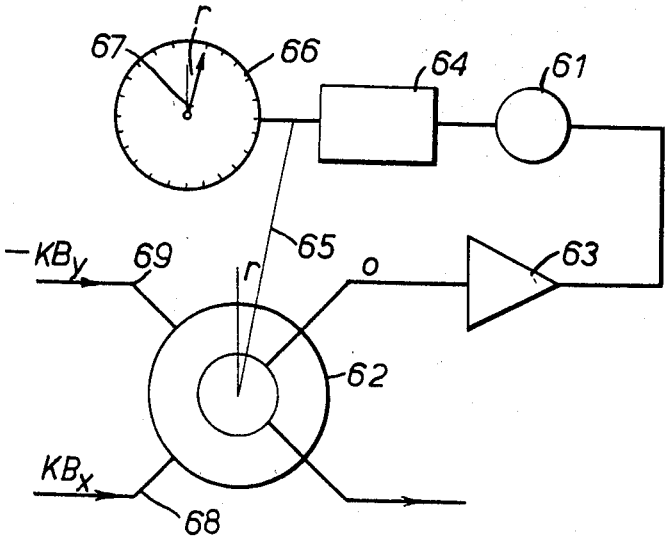
Figure 7:
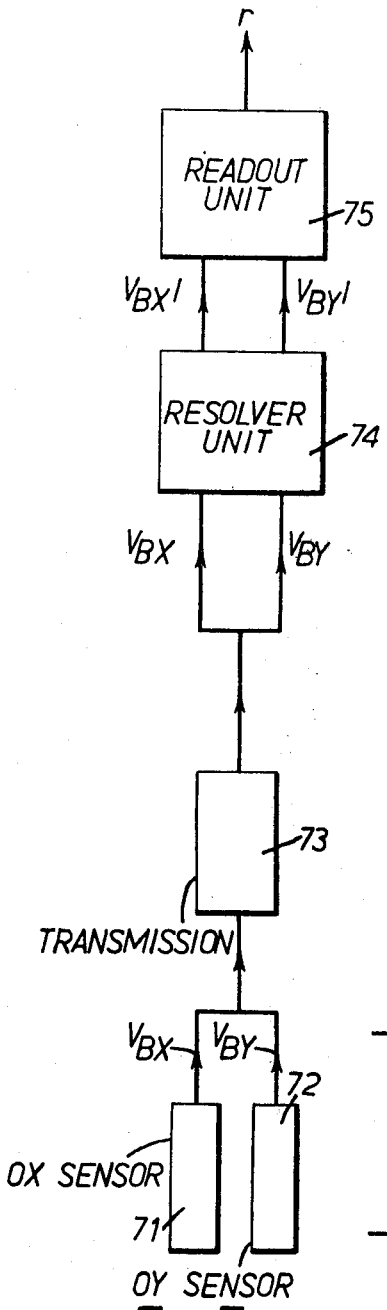
Figure 9:
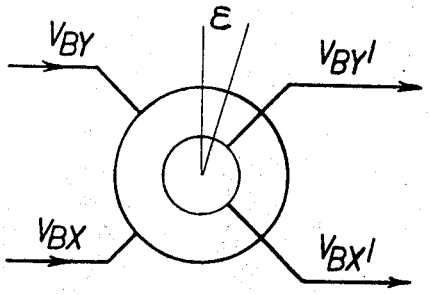
Figure 10:
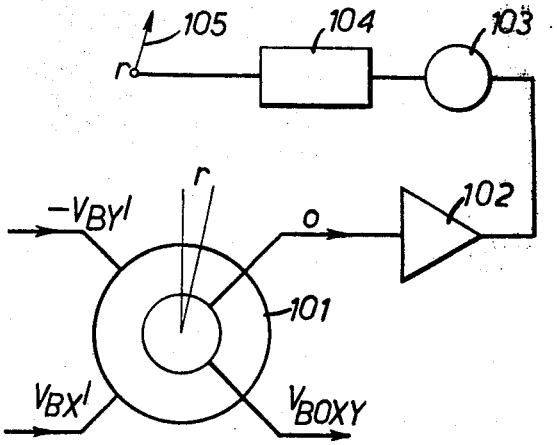
Figure 8:
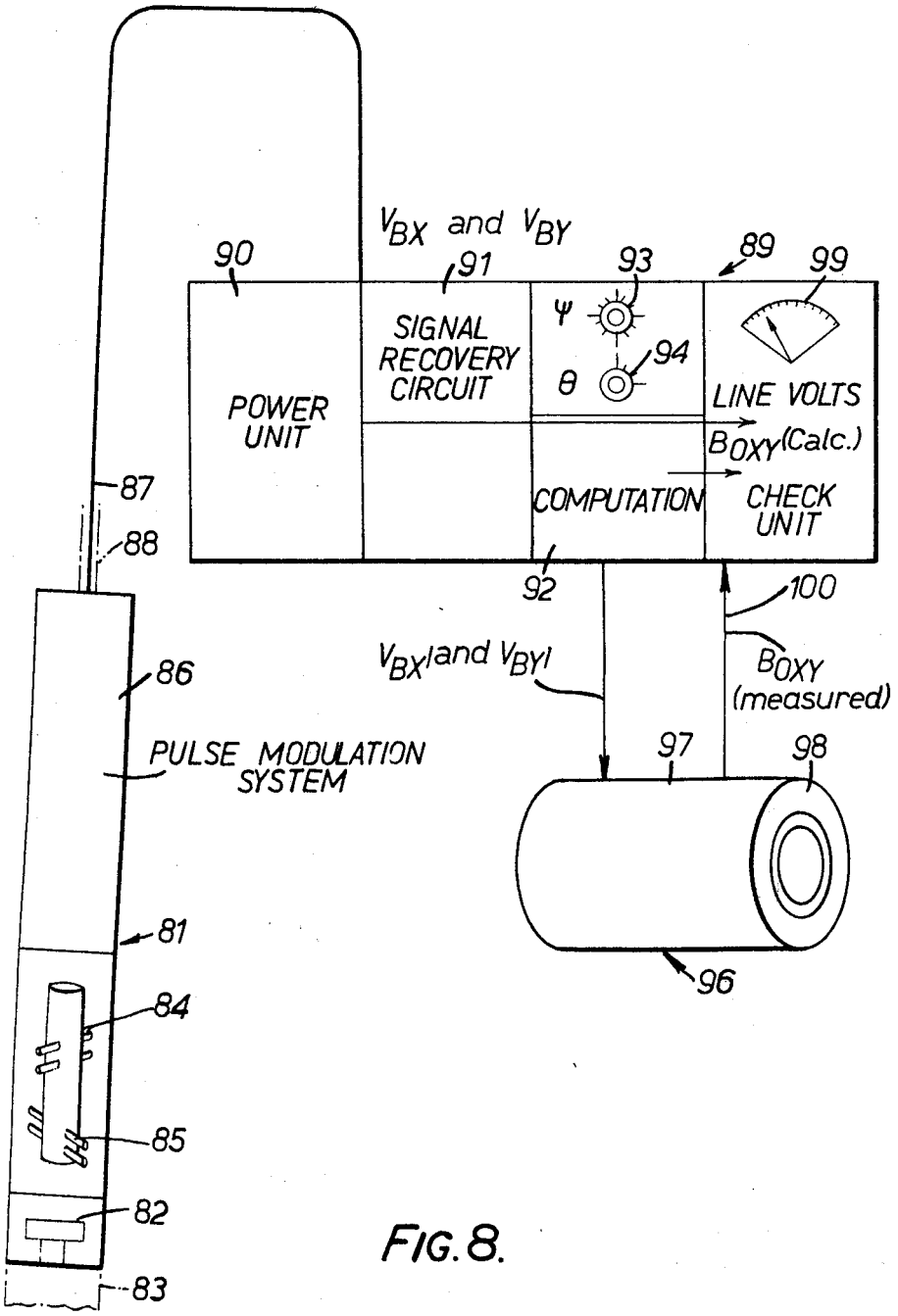
Figure 12:
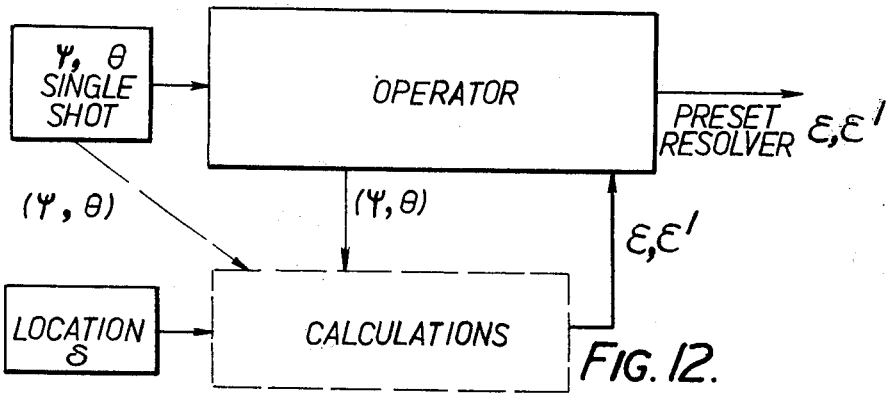
Figure 13:
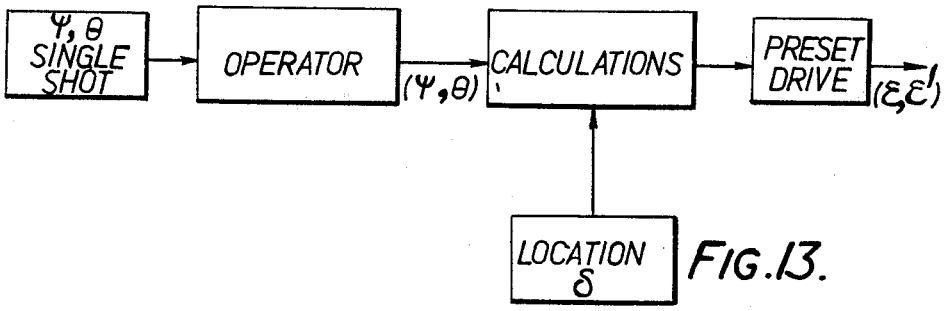
Figure 14:
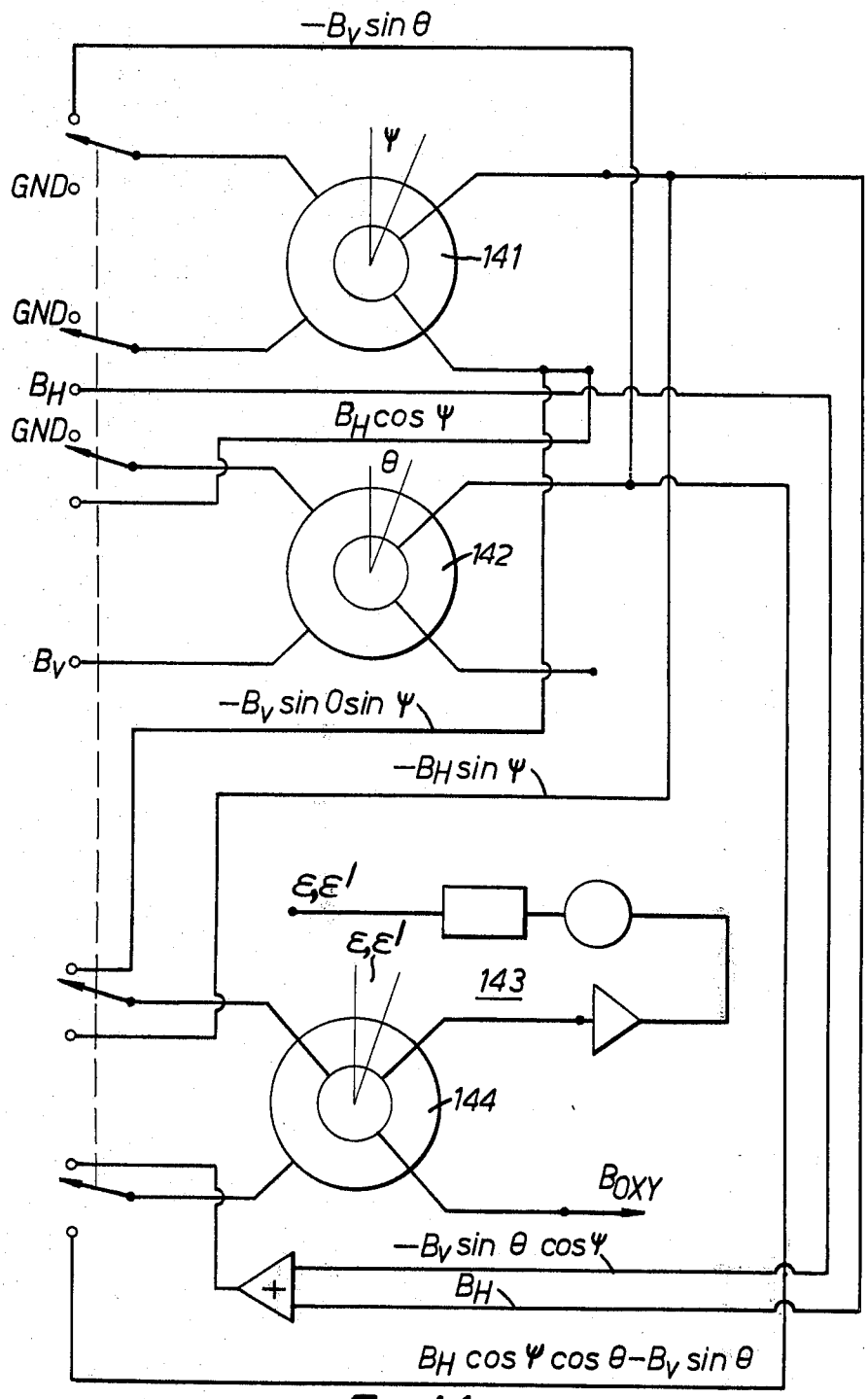
Figure 15:
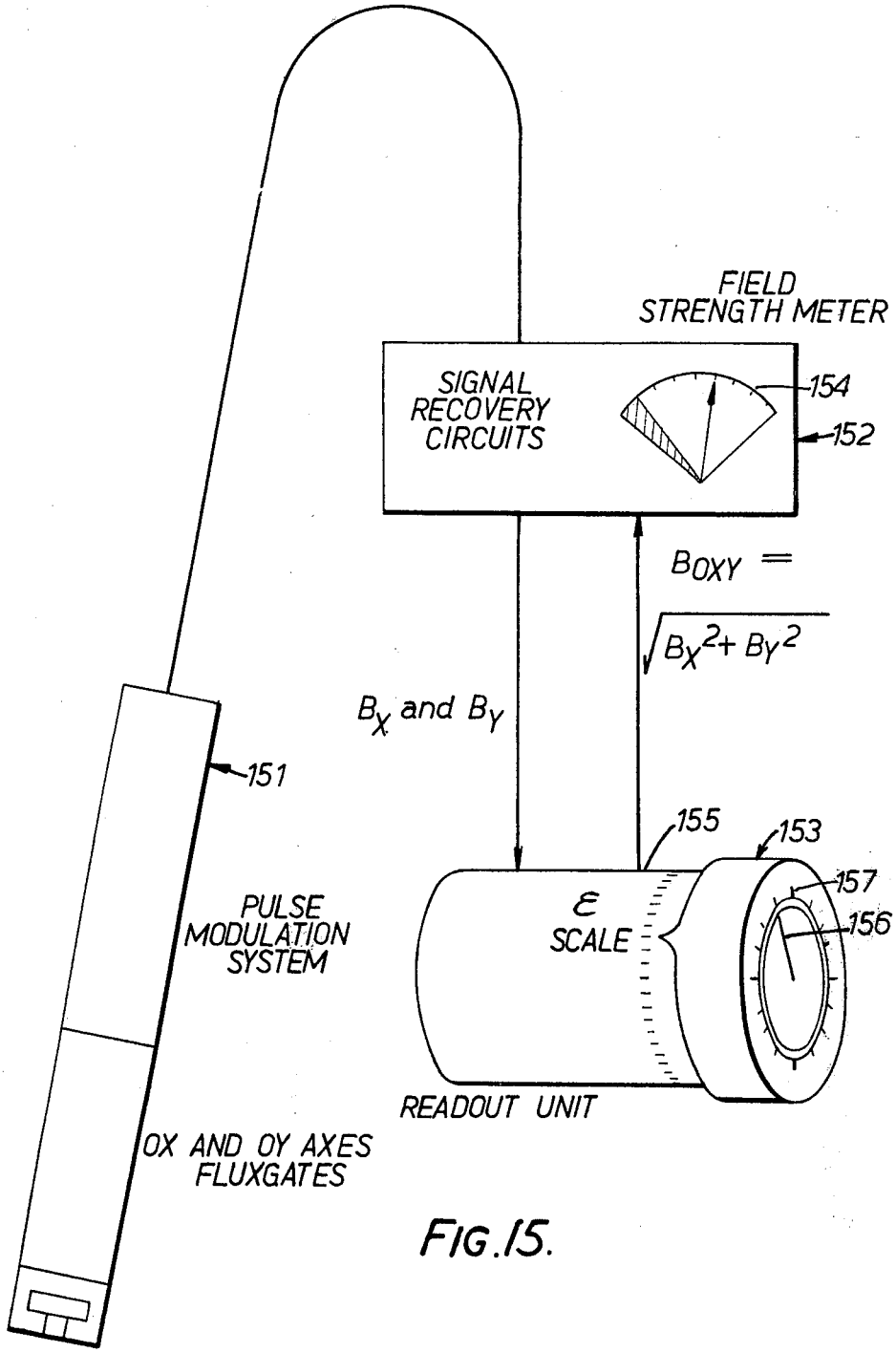

The determination of the orientation of a drilling tool, specifically a mud-motor, in accordance with the invention will now be described in more detail, and specific forms of equipment embodying the invention will also be described with reference to the accompanying drawings, in which:

FIG. 1 is a diagram showing the earth fixed axes and the tool fixed axes,

FIGS. 2, 3 and 4 illustrate three successive rotations relating the earth axes to the tool axes, FIG. 5 is a diagram representing the bottom of the borehole, FIG. 6 shows diagrammatically a readout resolver servo to which signals from crossed magnetic sensors are applied, FIG. 7 is a block diagram of the preferred system, FIG. 8. shows equipment suited to the system of FIG. 7, FIGS. 9 and 10 show successive resolver arrangements in the system of FIG. 7, FIGS. 11, 12 and 13 are block diagrams illustrative of alternative methods of computing pre-set angles, FIG. 14 is a circuit diagram for analogue computation of required modifying angles, and FIG. 15 illustrates equipment alternative to that of FIG. 8.

The method assumes the availability of single shot readings relating to the borehole immediately prior to a tool run and provides during the tool run high-side and/or magnetic readings of the tool face orientation from the outputs of just two magnetic sensors. The equipment described is effective for hole directions differing by more than about 5° from the direction of the resultant magnetic field of the earth at the hole location. For smaller angles a complementary high-side tool may be used, but since the number of occasions for such use is small it suffices to hold a small number of such high-side tools for issue and use in the field as required.

Geometric considerations call for rotations from the earth fixed axes into the tool fixed axes involving the azimuth angle $\psi$, the pitch angle $\theta$ and the roll angle $\phi$.

Referring to FIG. 1, in which 10 represents the borehole, the earth fixed axes are defined as three mutually perpendicular axes as follows:

ON Horizontal North,
OE Horzontal East,
OV Vertically Down.

These axes can be rotated into a hole-fixed or tool-fixed set of axes as follows:

OX Perpendicular to the Hole axis and defining the T-Head direction, (T-Head refers to a guide on a mud motor for orienting the steering equipment relative to the drill bit)

OY Perpendicular to the Hole axis and perpendicular to T-Head direction,

OZ Hole axis.

The earth-fixed set of axes rotate into the tool-fixed set of axes via the following clockwise rotations:

a. Rotation about OV through the azimuth angle $\psi$ as shown in FIG. 2. A vector $\overline{V}$ with components $V_N$ along ON, $V_E$ along OE and $V_V$ along OV will have components $V_{N1}$ along $ON_1$, $\overline{V}_{E1}$ along $OE_1$ and $V_V$ along OV, where $$V_{N1} = V_N \cos\psi + V_E \sin\psi,$$

$$V_{E1} = -V_N \sin\psi + V_E \cos\psi.$$

b. Rotation about $OE_1$ through the drift angle $\theta$ as shown in FIG. 3. The vector $\overline{V}$ with components $V_{N1}$ along $ON_1$, $V_{E1}$ along $OE_1$ and $V_V$ along OV will have components $V_{N2}$ along $ON_2$, $V_{E1}$ along $OE_1$ and $V_Z$ along OZ, where $$V_{N2} = V_{N1}\cos\theta - V_V\sin\theta = V_N\cos\theta\cdot\cos\psi + V_E\cos\theta\cdot\sin\psi - V_V\sin\theta.$$

$$V_Z = V_{N1}\sin\theta + V_V\cos\theta = V_N\sin\theta\cdot\cos\psi + V_E\sin\theta\cdot\sin\psi + V_V\cos\theta.$$

c. Rotation about OZ through the high-side angle $\phi$ as shown in FIG. 4. The vector $\overline{V}$ with components $V_{N2}$ along $ON_2$, $V_{E1}$ along $OE_1$ and $V_Z$ along OZ will have components $V_X$ along OX, and $V_Y$ along OY, and $V_Z$ along OZ, where $$V_X = V_{N2}\cos\phi + V_{E1}\sin\phi = V_N(\cos\phi\cos\theta\cos\psi - \sin\phi\sin\psi) + V_E(\cos\phi\cos\theta\sin\psi + \sin\phi\cos\psi) - V_V\cos\phi\sin\theta,$$

$$V_Y = -V_{N2}\sin\phi + V_{E1}\cos\phi = V_N(-\sin\phi\cos\theta\cos\psi - \cos\phi\sin\psi) + V_E(-\sin\phi\cos\theta\sin\psi + \cos\phi\cos\psi) + V_V\sin\phi\sin\theta,$$

$$V_Z = V_N\sin\theta\cos\psi + V_E\sin\theta\sin\psi + V_V\cos\theta.$$

If $\theta$ and $\psi$ are known from a prior single shot measurement and do not change significantly during the course of a tool run, then measurements of $B_x$ and $B_y$ can yield either the high-side parameter $\phi$ required for high angle holes or the magnetic parameter $\psi + \phi$ required for low angle holes, since $B_v/B_h$ will be known for any particular location. The manner of extracting these parameters will be described with reference to FIG. 5 which represents a cross-section of the hole bottom where the hole direction, prior to renewed drilling, is surveyed to yield pitch angle $\theta$ and azimuth angle $\psi$. $\epsilon$, the angle between the highside direction and the direction of the component of the earth's magnetic field $\overline{B}$ in this plane, is a function of $\theta$, $\psi$ and the magnetic dip angle $\delta$ at the site. This function can be calculated prior to the tool run. Magnetic sensors along the tool-fixed axes yield values $K\cdot B_x$ and $K\cdot B_y$ where $B_x$ and $B_y$ are the components of $\overline{B}$ in the tool-fixed axes directions and K is a constant. If $K\cdot B_x$ and $K\cdot B_y$ are fed into the readout unit resolver servo shown in FIG. 6, the readout pointer and scale yield angle $r$, where $$\frac{\sin r}{\cos r} = \frac{-B_y}{-B_x},$$

Thus, $r - -\gamma$.

The required high-side angle $\phi = \epsilon - \gamma = \epsilon + r$ can be obtained in any one of three ways as follows:

a. Read angle $r$ on readout scale and add $\epsilon$ to this reading to obtain $\phi$.

b. Rotate the readout outer scale counterclockwise with respect to the pointer through angle $\epsilon$ prior to drilling. The readout pointer/scale reading will then yield $\phi$ directly.

c. Rotate the readout pointer clockwise with respect to the outer scale through angle $\epsilon$ prior to drilling. The readout pointer/scale reading will then read $\phi$ directly. in the preferred system described hereafter, method (c) is carried out by rotating the vector components $K\cdot B_x$ and $K\cdot B_y$ through angle $\epsilon$ prior to feeding them into the readout resolver servo.

The magnetic steering parameter can be obtained in a similar manner by adding a correction $\epsilon'$, where $\epsilon'$ is the angle between the direction of this parameter, and the direction of the component of the earth's magnetic field $\overline{B}$ in the transverse plane of the hole, this angle being again a function of $\theta$, $\psi$ and $\delta$.

The arrangement in FIG. 6 is a conventional electromechanical resolver servo unit comprising a motor 61 fed by a resolver 62 through an amplifier 63 and coupled to the resolver through a reduction gear 64 and a coupling 65 to rotate the resolver 62 through an angle indicated on the scale 66 by a pointer 67 when electrical signals representing the sine and cosine of that angle are applied to appropriate resolver input connections 68 and 69.

A block diagram of the preferred system is shown in FIG. 7, and a pictorial view showing a convenient arrangement of the parts of the system is shown in FIG. 8. OX and OY sensors 71 and 72 at the location of the drilling tool in the borehole deliver signals $V_{BX}$ and $V_{BY}$ to transmission means 73, whereby the said signals are fed to a resolver unit 74 at the surface drilling station from which modified signals $V_{BX_1}$ ane $V_{BY_1}$ are applied to a readout unit 75 to indicate the required angle *r*.

In the preferred form of tool steering equipment, that is, orientation determining equipment to assist in steering, shown in FIG. 8, the downhole assembly 81 is located by guides 82 in a fixed attitude with respect to the T-slotted head 83 of the mud motor and contains two magnetic flux gates 84 and 85 mounted (usually aligned with the T-slot) in such a way that their sensitivity axes are the OX and OY axes of the previous discussion. This assembly 81 also houses associated signal processing circuitry 86 to allow transmission by a conventional pulse modulation technique through a single conductor 87 in a protective sheath 88 providing a ground return path. The surface equipment comprises a unit 89 containing a power supply sub-assembly 90, pulse reception and signal recovery circuitry in a sub-assembly 91 and computation circuitry in a sub-assembly 92. The angles $\psi$ and $\theta$ are set up on dials 93 and 94 respectively for the feeding of the angle information to the computation circuitry. The unit 89 further comprises a read-out unit 96 in the form of a resolver servo 97 and an indicating dial 98. A meter 99 which indicates the strength of the earth's magnetic field in the measuring plane BOXY is located in the unit 89. The meter 99 indicates the calculated field value supplied by the computation circuit sub-assembly 92 and also, simultaneously or alternatively for comparison, the measured field value supplied by the resolver servo 97 over a connection 100.

PRINCIPLE OF OPERATION

The components of the earth's magnetic field in the directions of the previously defined earth-fixed axes are as follows;

$B_H$ in direction ON (North),

Zero in direction OE (East), $B_V$ in direction OV (Vertically down).

Thus, the components of the earth's magnetic field in the directions OX and OY of the previously defined tool-fixed axes will be as follows:-

$$B_X = B_H(\cos\phi\cos\theta\cos\psi - \sin\phi\sin\psi) - B_V\cos\phi\sin\theta \quad (1)$$

in direction OX, $$B_Y = -B_H(\sin\phi\cos\theta\cos\psi + \cos\phi\sin\psi) + B_V\sin\phi\sin\theta \quad (2)$$

in direction OY.

As represented in FIG. 9, voltage analogues $V_{BX} = K \cdot B_X$ and $V_{BY} = K \cdot B_Y$ which are derived from the downhole probe sensors are passed into the resolver which is preset at angle $\epsilon$, where $$\sin\epsilon = -P.\sin\psi \quad (3)$$

$$\cos\epsilon = P(\cos\theta\cos\psi - \tan\delta\sin\theta) \quad (4)$$

P and K are positive constants and $\tan\delta = B_V/B_H$. The value of $\epsilon$ is independent of $B_X$ and $B_Y$ and is derived from a knowledge of the single shot measurements of $\psi$ and $\theta$ read immediately prior to the tool run, together with the value of the dip angle $\delta$ for the drilling site location. Clearly, $$\tan\epsilon = \frac{-\sin\psi}{\cos\phi\cos\psi - \tan\delta\sin\phi} \quad (5)$$

The outputs from this resolver are $V_{BX'}$ and $V_{BY'}$ where, as the result of anticlockwise rotation of $V_{BX}$ and $V_{BY}$ through angle $\epsilon$, $$V_{BY'} = V_{BY}\cos\epsilon - V_{BX}\sin\epsilon \quad (6)$$

$$V_{BX'} = V_{BY}\sin\epsilon + V_{BX}\cos\epsilon \quad (7)$$

$V_{BX'}$ and $-V_{BY'}$ are the inputs to a resolver servo shown in FIG. 10 and comprising resolver 101, amplifier 102, motor 103 and reduction gear 104 which drives the readout pointer 105 through a clockwise angle r, where $$\frac{\sin r}{\cos r} = \frac{-V_{BY'}}{V_{BX'}} \quad (8)$$

The resolver outputs of this unit are zero and $V_{BOXY}$, where $$V_{BOXY} = -V_{BY'}\sin r + V_{BX'}\cos r = (V_{BX}^2 + V_{BY}^2) \quad (9)$$

From equations (6), (7) and (8)

$$\frac{\sin r}{\cos r} = \frac{-V_{BY}\cos\epsilon + V_{BX}\sin\epsilon}{V_{BY}\sin\epsilon + V_{BX}\cos\epsilon} \quad (10)$$

Thus, making use of equations (1) and (2), $$\frac{\sin r}{\cos r} = \frac{\begin{array}{c}\cos\epsilon\sin\phi\cos\theta\cos\psi + \cos\epsilon\cos\phi\sin\psi - \cos\epsilon\tan\delta\sin\phi\sin\theta \\ +\sin\epsilon\cos\phi\cos\theta\cos\psi - \sin\epsilon\sin\phi\sin\psi - \sin\epsilon\tan\delta\cos\phi\sin\theta\end{array}}{\begin{array}{c}-\sin\epsilon\sin\phi\cos\theta\cos\psi - \sin\epsilon\cos\phi\sin\psi + \sin\epsilon\tan\delta\sin\phi\sin\theta \\ +\cos\epsilon\cos\phi\cos\theta\cos\psi - \cos\epsilon\sin\phi\sin\psi - \cos\epsilon\tan\delta\cos\phi\sin\theta\end{array}}$$

$$= \frac{\begin{array}{c}\sin\phi\,[\cos\epsilon(\cos\phi\cos\psi - \tan\delta\sin\theta) - \sin\epsilon\sin\psi] \\ +\cos\phi\,[\sin\epsilon(\cos\theta\cos\psi - \tan\delta\sin\theta) + \cos\epsilon\sin\psi]\end{array}}{\begin{array}{c}\cos\phi\,[\cos\epsilon(\cos\theta\cos\psi - \tan\delta\sin\theta) - \sin\epsilon\sin\psi] \\ -\sin\phi\,[\sin\epsilon(\cos\theta\cos\psi - \tan\delta\sin\theta) + \cos\epsilon\sin\psi]\end{array}}$$

Substitution of equations (3) and (4) leads directly to $$\frac{\sin r}{\cos r} = \frac{\sin\phi\,(\cos^2\epsilon + \sin^2\epsilon) + \cos\phi\,(\sin\epsilon\cos\epsilon - \cos\epsilon\sin\epsilon)}{\cos\phi\,(\cos^2\epsilon + \sin^2\epsilon) - \sin\phi\,(\sin\epsilon\cos\epsilon - \cos\epsilon\sin\epsilon)}$$

$$= \frac{\sin\phi}{\cos\phi}$$

Thus, clearly the readout angle *r* is the high-side angle $\phi$.

If the preset resolver angle is set at angle $\epsilon'$, where $$\sin\epsilon' = -P\sin\theta\sin\psi\tan\delta \quad (11)$$

$$\cos\epsilon' = P(1 - \sin\theta\cos\psi\tan\delta) \quad (12)$$

and *P* is a positive constant, then for small angles $\theta$ this system will yield a readout angle r equal to the magnetic steering parameter *m*, where $m = \phi + \psi$. Clearly, $$\frac{\sin r}{\cos r} = \frac{-V_{BY}\cos\epsilon' + V_{BX}\sin\epsilon'}{V_{BY}\sin\epsilon' + V_{BX}\cos\epsilon'} \quad (13)$$

Equations (1) and (2) for the small angle $\theta$ case become $$B_X = B_H\cos m - B_V\sin\theta\cos\psi\cos m - B_V\sin\theta\sin m\sin\psi \quad (14)$$

$$B_Y = -B_H\sin m + B_V\sin\theta\sin m\cos\psi + B_V\sin\theta\cos m\sin\psi \quad (15)$$

Thus, $$\frac{\sin r}{\cos r} = \frac{\sin m\,[\cos\epsilon'(1-\sin\theta\cos\psi\tan\delta) - \sin\epsilon'\sin\theta\sin\psi\tan\delta] + \cos m\,[\sin\epsilon'(1-\sin\theta\cos\psi\tan\delta) + \cos\epsilon'\sin\theta\sin\psi\tan\delta]}{\cos m\,[\cos\epsilon'(1-\sin\theta\cos\psi\tan\delta) - \sin\epsilon'\sin\theta\sin\psi\tan\delta] - \sin m\,[\sin\epsilon'(1-\sin\theta\cos\psi\tan\delta) + \cos\epsilon'\sin\theta\sin\psi\tan\delta]}$$

$$= \frac{\sin m(\cos^2\epsilon'+\sin^2\epsilon' + \cos m\,(\sin\epsilon'\cos\epsilon'\cos\epsilon'\sin\epsilon'}{\cos m(\cos^2\epsilon'+\sin^2\epsilon' - \sin m\,(\sin\epsilon'\cos\epsilon'-\cos\epsilon'\sin\epsilon')}$$

$$= \frac{\sin m}{\cos m}$$

and clearly the readout angle $r$ is equal to the magnetic steering parameter $m$.

COMPUTATION OF PRESET ANGLES $\epsilon$ AND $\epsilon'$

The values of $\epsilon$ and $\epsilon'$ are independant of the sensing probe outputs $V_{BX}$ and $V_{BY}$ and are functions of only the known geometry of the hole pertaining prior to the tool-run and the earth's magnetic field at the site location. There are basically three ways by which the $\epsilon$ and $\epsilon'$ values can be derived and used for the preset of the resolver operation. All of these ways will involve either directly or indirectly the calculation of $\epsilon$ from $$\tan\epsilon = \frac{-\sin\psi}{\cos\phi\cos\psi-\tan\delta\,\sin\phi} \qquad (16)$$

and the calculation of $\epsilon'$ from $$\tan\epsilon' = \frac{-\sin\phi\sin\psi\tan\delta}{1-\sin\phi\cos\psi\tan\delta} \qquad (17)$$

These calculations could be performed on a single occasion for each set of $\psi$, $\theta$ and $\delta$ and the results could be tabulated and filed for use on all future occasions (Method *a* below). Alternatively, $\epsilon$ and $\epsilon'$ may be calculated for the appropriate set of $\psi$, $\theta$ and $\delta$ values as the occasion demands. The calculations may be done separately prior to each tool run, for example by reference to a computing centre (method *b* below), or they may be done in the computation assembly incorporated in the orientation determining equipment itself (method *c* below).

Figure 11:
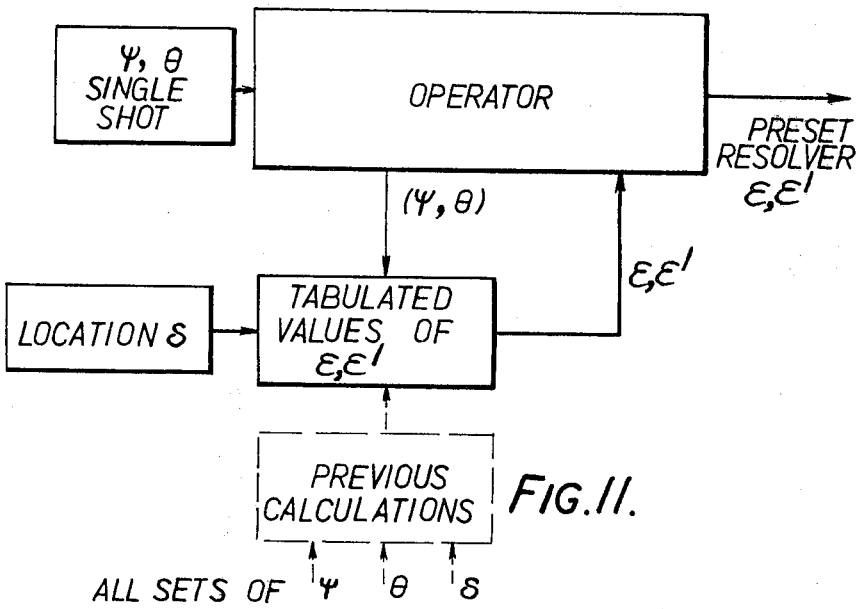

A block diagram illustrating method *a* is shown in FIG. 11. The operator receives the ($\psi$, $\theta$) set from the single shot measurement taken immediately prior to the tool-run and looks up the corresponding $\epsilon$ and $\epsilon'$ values in previously computed tables which list all the $\epsilon$ and $\epsilon'$ values appropriate to the site location for any given ($\psi$, $\theta$) set. The operator then sets the resolver to either $\epsilon$ or $\epsilon'$, depending on whether the high-side or the magnetic parameter is required for steering.

A block diagram illustrating method *b* is shown in FIG. 12. The ($\psi$,$\theta$) set from the single shot measurement prior to the tool run is fed either directly or via the operator to a computation centre where the calculation of the corresponding $\epsilon$ and $\epsilon'$ values is performed (or these values are determined from the results of previous calculations). The computation centre then informs the operator of the $\epsilon$ (or $\epsilon'$) value to be preset on the resolver.

A block diagram of method *c* is shown in FIG. 13. In this method the $\epsilon$, $\epsilon'$ computation unit forms part of the steering tool equipment. The operator has to perform only the relatively simple task of setting the single shot ($\psi$, $\theta$) information directly into the onsite equipment. The calculations of $\epsilon$ and $\epsilon'$ and the resolver preset operation are performed within the tool steering equipment. While method (c) does require that the tool steering equipment will be rather more sophisticated, and hence rather more expensive, it does have the very important advantage of making the task of the operator very much less complicated than in the case of method (a) or method (b).

$\epsilon$ OR $\epsilon'$ COMPUTERS

Clearly $\epsilon$ and $\epsilon'$ could be computed from equations (16) and (17) using a suitably programmed digital computer. However, $\epsilon$ and $\epsilon'$ are essentially related to vector rotations and can be conveniently computed by an analogue technique. The essential features of the $\epsilon$, $\epsilon'$ analogue computer are illustrated in FIG. 14. Angles $\psi$ and $\theta$ are set up on resolvers 144 and 142 respectively, from which products such as $-B_V \sin\theta \sin\psi$ can be derived and applied to a resolver servo 143, the resolver 144 of which sets itself to the required angle $\epsilon$ or $\epsilon'$ and also yields $B_{OXY}$ as an output.

Major advantages of this system are:

a. Either high-side or magnetic steering parameters can be chosen through the operation of a five pole two-way switch.

b. The computer outputs $\epsilon$ and $\epsilon'$ are in the form of a driven shaft rotation which can be used to set the preset resolver directly.

c. The system also yields the expected value of $B_{OXY}$ which can be compared to the measured value of $B_{OXY}$ (see equation 9) as a system check. The value of $B_{OXY}$ can also be used to warn the operator should he try to operate the tool within the forbidden zone. (Satisfactory operation will not be achieved for hole geometries in which the direction of the hole lies very close to the direction of the earth's magnetic field since $V_{BX}$ and $V_{BY}$ will be very small in this case. These occasions are likely to be very rare).

In the arrangement of equipment shown in FIG. 15, method *a* or *b* is used to arrive at the preset angle $\epsilon$ or $\epsilon'$, and zero setting against an appropriate scale on the indicator is used to introduce the preset angle into the reading.

The downhole assembly 151 is as described with reference to FIG. 8. The surface equipment comprises a unit 152 containing reception and signal recovery circuitry, a read-out unit 153 and a meter 154 which indicates the strength of the earth's magnetic field in the measuring plane OXY. The resolver servo 155 is located in the read-out unit. The read-out unit pointer 156 moves over a scale 157 which can itself be rotated about the pointer rotation axis through any given angle.

The operating procedure is as follows:

a. The operator acquires the drift and azimuth angles from the most recent single shot run and is instructed by the directional driller as to the requirement for either the high-side or the magnetic steering parameter.

b. Using this information, together with the tabulated $\epsilon$ (or $\epsilon'$) values for the geographical location of the drilling site, the operator determines the appropriate value of $\epsilon$ (or $\epsilon'$) and the expected value of the magnetic field strength parameter $B_{OXY}$.

c. The operator sets the read-out rotatable scale 157 to the determined value of $\epsilon$ (or $\epsilon'$).

d. The tool is then run in the hole and seated repeatedly until three consecutive identical tool face orientations are obtained. The operator also checks the magnetic field strength meter reading with the expected $B_{OXY}$ value.

e. If (d) is completed satisfactorily, drilling may proceed, and during drilling the necessary steering parameter, either the roll angle $\phi$ or the magnetic angle $m = \psi + \phi$, is continuously presented to the operator.

f. As drilling proceeds, the $\epsilon$ (or $\epsilon'$) value is updated as each set of single shot readings is obtained.

In a typical example of operation, high-side information is required for a tool run on a drilling site at which the earth's magnetic field parameters are $B_h = 0.187$ and $B_v = 0.434$ (c.g.s.). Single shot measurements immediately prior to the run yield azimuth and drift angles $\psi = 545°W$ and $\theta = 15°$ respectively. Thus, the 'fixed' parameters at the time of the run are $\psi = 225°$, $\theta = 15°$ and $= \tan^{-1}B_v/B_h = 66°42'$. For this set of 'fixed' parameters, the corresponding value of $\epsilon$ listed in the tables derived from equation 5 is found to be $\epsilon = 151°$. This value of $\epsilon$ is set on the read-out unit $\epsilon$ scale. From equations (1) and (2), the magnetic field component $B_{OXY} = \sqrt{Bx^2 + By^2} = \sqrt{B_h^2 (\cos^2\theta\cos^2\psi + \sin^2\psi) + B_v^2\sin^2\theta - 2B_vB_h \sin\theta\cos\theta\cos\psi}$ and from tables of $B_{OXY}$ based on this equation the value of $B_{OXY}$ corresponding to the set of 'fixed' parameters is found to be $B_{OXY} = 0.274$. Operations (a), (b) and (c) have now been completed and operations (d), (e) and (f) may be proceeded with.

In order to further amplify the principles of the invention set forth herein the following is by way of summary and further clarification.

The following is a description of conventional geometry which is used in borehole surveying. The direction in space of a borehole at any particular station along its length is conveniently described in terms of two right-handed rotations from an earth-fixed set of axis into a hole-fixed set of axes. Defining the earth-fixed set of axes as three mutually perpendicular axes ON, horizontal north, OE, horizontal east, and OV vertical down (see FIGS. 1, 2, 3 and 4), these axes can be rotated into a hole-fixed set of axes as follows: (1) rotation about OV through the azimuth angle $\psi$ into the set of axes $ON_1$, $OE_1$ and OV; and (2) rotation about $OE_1$ through the inclination angle $\theta$ into the hole-fixed set of axes $ON_2$, $OE_1$ and OZ where OZ lies along the longitudinal axis of the hole at the station being considered and $ON_2$ lies in a vertical plane which includes a diameter of the hole section passing through the highest point of the hole in the section at the station considered.

The above-identified rotated angles are commonly known as Euler angles as typically applied in aerodynamics wherein the position of a body-fixed set of axes is defined relative to an earth-fixed set of axes by three rotations about the body-fixed axes (azimuth, pitch and roll) from an initial position where the body-fixed axes and earth-fixed axes coincide. For a description of this concept see "The Gyroscope" by James B. Scarborough, Interscience Publishers Ltd., 1958, p. 33.

In accordance with this invention, in a directional drilling operation, a steering instrument or tool is located in the drill stem and is oriented therein by means of a "muleshoe" located in the lower end of the drill stem. The muleshoe captures the instrument and orients the instrument in a particular direction with respect to a predetermined point on the drill stem. The drill stem normally used in such a directional drilling operation has what is termed a "bent sub" at its lower end which angles the lower end of the stem and thereby permits angular deviation of the drill head or bit. The muleshoe is oriented with respect to the bent sub. This in turn orients the steering instrument with respect to the bent sub. A single shot survey tool is used to determine the directional attitude of the hole prior to using the steering tool. The frequency of taking single shot readings is normally determined by the critical nature of the steering operation. However, during normal directional drilling operations, such single shot survey readings may typically be made every 90 feet of drilling depth. Such a single shot survey defines the longitudinal axis of the hole in terms of inclination from vertical $\theta$ and azimuth $\psi$. This in turn defines a section of the hole, i.e., a section lying in a plane which is perpendicular to the longitudinal axis of the hole or drill stem.

For directional drilling purposes, the roll angle of a drill head is defined in terms of a rotation of the hole-fixed set of axes about axes OZ (longitudinal axis of the tool) through the high side angle $\phi$ into a body-fixed or tool-fixed set of axes OX, OY, or OZ, where OX lies along the direction of the bent sub or along the direction of the drill head. As described above, the bent sub when used in a drill string lies at an angle with respect to the longitudinal axis of the drill pipe. The axis OX, as used herein is arranged within the tool string so that it physically is constrained to lie in the plane of the bent sub. These tool-fixed sets of axes are now fixedly related to the tool housing and the bent sub by means of the muleshoe and lug or cam on the tool housing, such devices as the muleshoe and lug being conventional arrangements for orienting devices with respect to the tool string. Such an arrangement is set forth in greater detail in the U.S. Pat. No. 3,718,194. The fixed relation described above between OX and the tool permits geometrical rotation of these axes back into the earth-fixed sets of axes to define the attitude of the tool with respect to the earth's surface.

In the use of the apparatus described herein for measuring the roll angle of the drill head, information is conveniently presented to the driller as follows: (1) the high side angle $\phi$ itself is presented, i.e., how far the plane OX is rotated away from the top of the hole (2) the high side angle $\phi$ plus the hole azimuth angle $\psi$ is presented when used in near vertical holes (up to 10°) wherein you add the roll angle to the azimuth angle to get the azimuth of the tool with respect to North. In a near vertical hole this is the information desired since there is no high side to be ascertained for all practical purposes (3) in the case of a vertical hole which is a special case of (2) above, the angle through which the earth-fixed set of axes must be rotated about OV is presented such that the new set of axes is the tool-fixed set of axes OX, OY and OZ. This can only be achieved in the special case of a vertical hole when the high side angle $\phi$ and the hole azimuth angle $\psi$ become indeterminate.

In order to obtain roll angle reference directions, and excluding for the time being the special case of the vertical hole, the reference direction for the high side angle $\phi$ is clearly the hole-fixed axes $ON_2$ which defines the highest point of the hole at the section being considered and is in the vertical plane of the hole. As used hereinafter the term section will refer to that plane as shown in FIG. 1, containing the lines $ON_2$ and $OE_1$, where $ON_2$ lies in a vertical plane of the hole and passes through the high side of the hole. Since the hole-fixed axes are uniquely defined in earth-fixed space by the two rotation angles $\psi$ and $\theta$, then both the hole fixed axis $ON_2$ and the section as described above or sectional plane at the station considered are both uniquely defined in earth-fixed space by the two parameters $\psi$ and $\theta$. Since the direction of the earth's magnetic field is uniquely defined with respect to the earth-fixed set of axes through the magnetic dip angle $\delta$ it follows that the direction of a component of the earth's magnetic field which lies in the sectional plane through the hole at the station considered must be uniquely defined in terms of the three angles $\psi$, $\theta$, and $\delta$. Thus, since axes $ON_2$ is defined in terms of $\psi$ and $\theta$, and the direction of the component of the earth's magnetic field $\overline{B}$ (FIG. 5) lying in the sectional plane containing $ON_2$ and $OE_1$ is defined in terms of $\psi$, $\theta$, and $\delta$, then the angle between $ON_2$ and $\overline{B}$ must also be defined by a function of $\theta$, $\psi$ and $\delta$.

Therefore, if the angle of the drill head with respect to the direction of $\overline{B}$ can be measured and the particular set of ($\psi$, $\theta$, and $\delta$) is known for the station ($ON_2$) then a correction in terms of a calculated unique function $\epsilon$ of $\psi$, $\theta$, and $\delta$ can be applied to the measured angle in order to derive the high side angle $\phi$.

In the system described herein, the flux gates in the instrument are used to measure two components of the earth's field component $\overline{B}$ in the sectional plane. With these two components we electronically and mathematically build the angle $\delta$ of $\overline{B}$ with respect to OX, (see FIG. 5). Thus, the prime function of the tool is to measure parameters in order to calculate $\delta$ which we subtract from $\epsilon$ to obtain $\phi$ or the high side angle.

Referring to FIGS. 2, 3 and 5 an explanation is again given of the correction factor $\epsilon$. The correction factor $\epsilon$ has nothing to do with the measurements which are made by the tool. The correction factor merely explains the mathematical relation between $ON_2$ and $\overline{B}$ so that later when we measure components of $\overline{B}$ in the sectional plane, we can relate these component measurements to $ON_2$ or high side. The $\epsilon$ exercise is precomputed and put into tabular form for field use.

The correction function $\epsilon$ is simply the angle between the directions $ON_2$ and $\overline{B}$. The measured components of the earth's magnetic field $\overline{B}$ are $B_H$ along ON, zero along OE, and $B_V$ along OV, where $\tan\delta = B_V/B_H$. Thus the components of $\overline{B}$ along the set of axes OV, $ON_1$ and OE, will be $B_V$ along OV, $B_H \cos\psi$ along $ON_1$ and $-B_H \sin\psi$ along $OE_1$. The components of $\overline{B}$ along the set of axes $ON_2$, $OE_1$ and OZ can then be written, $B_H \cos\psi . \cos\theta - B_V \cdot \sin\theta$ along $ON_2$, $-B_H \sin\psi$ along $OE_1$ and $B_H \cos\psi \cdot \sin\theta + B_V \cdot \cos\theta$ along OZ The angle between $ON_2$ and the direction of $\overline{B}$ is given by $$\tan\epsilon = \frac{-B_H \sin}{B_H \cos\psi \cdot \cos\theta - B_V \cdot \sin\theta}$$

$$\text{or } \tan\epsilon = \frac{-\sin\psi}{\cos\psi \cdot \cos\theta - \tan\delta \cdot \sin\theta}$$

Again it is reemphasized that $\epsilon$ is only a function of the location of the borehole in space on the earth and is geographical. $\epsilon$ is not measured and has nothing to do with the measurements of the tool and is calculated.

The following is a description of the measurement of the drill head direction with respect to the direction of the component of the earth's magnetic field $\overline{B}$. (see FIG. 5).

The sensing unit containing the two magnetic flux gates is mounted in a fixed aspect with respect to the tool fixed axes in such a way that voltages $V_{BX}$ and $V_{BY}$, which are proportional to the components $B_X B_Y$ of the earth's magnetic field $\overline{B}$ along the OX and OY directions respectively in the sectional plane, are measured. One flux gate is aligned with OX and one with OY to measure components of $\overline{B}$ in these directions in the sectional plane. Then, $$V_{BX} = K \cdot B_x \cdot \cos\gamma$$

and $$V_{BY} = K \cdot B_x \cdot \sin\gamma$$

where K is a constant related to voltage scaling. The voltages $V_{BX}$ and $V_{BY}$ are then relayed to the top of the hole where they are processed.

Reference is next made to FIGS. 6–10 for a further description of signal processing if voltages $V_{BX}$ and $V_{BY}$ are fed into a readout unit resolver servo (FIG. 10). The use of a resolver servo for this purpose is an established technique whereupon an angle may be determined from two input signals proportional to the vector components defining the angle. The readout pointer scale 156 (FIG. 15) will indicate an angle $r$ where $\tan r = -V_{BY}/V_{BX} = -\sin\gamma/\cos\gamma$ and the direction of the drill head with respect to direction of $\overline{B}$ ($-\gamma$) is displayed. Thus, you drive the servo unit until $r = -\gamma$. In order to correct this reading to yield the direction of the drill head with respect to the direction $ON_2$ (top of the hole), it is necessary to add the value of $\epsilon$ corresponding to the particular set of $\psi$, $\theta$, and $\delta$, at the drilling situation. Values of $\epsilon$ corresponding to all possible sets ($\psi$, $\theta$, and $\delta$) can be predetermined through the expression for $\tan\epsilon$ heretofore described. These predetermined $\epsilon$ values are tabulated and used for on the spot correction at the drilling site.

The correction from $r$ to $\phi$ can be made in any one of three ways: (1) read angle or on readout scale and add the value of $\epsilon$ corresponding to the drilling situation pertaining at the time of the run (2) rotate the outer scale of the readout counterclockwise with respect to the pointer through the angle $\epsilon$; whereupon the readout scale will then indicate $\phi$ directly (3) rotate the readout pointer with respect to the outer scale through angle $\epsilon$ clockwise so that the readout will indicate $\phi$ directly. The tool may be constructed to make the $\epsilon$ correction by effectively performing the method in (3) by rotating each of the vector components represented by $V_{BX}$ and $V_{BY}$ through an angle $\epsilon$ prior to feeding them into the readout unit (FIG. 9). This may be performed in a standard resolver device.

For inclination in excess of 10° the normal roll angle for directional drilling is the angle $\phi$ itself. However, it is usual to use a roll angle equal to $\phi + \psi$ when the inclination is below 10°. To present the required low-angle roll angle directly, the correction to r is $\epsilon += \epsilon'$. These correction parameters can also be tabulated for all possible sets ($\psi$, $\theta$, and $\delta$). Thus to construct a table for $\epsilon'$ you add all values of $\psi$ and have a new set of tables.

The direction of the drill head in a vertical hole situation is specified for directional drilling purposes by $r$ itself and requires no correction. This is because the direction of $\overline{B}$ is north.

If $V_{BX}$ and $V_{BY}$ are fed into the resolver of the readout servo unit, in addition to the angle indicated on the readout scale; a voltage which is proportional to $\overline{B}$ ($V_{BOXY}$) is also derived (FIG. 10). In the steering tool operation, the magnitude of $\overline{B}$ is used to determine whether or not the size of the earth's components measured by the flux gates is sufficiently large to allow satisfactory operation of the tool.

The actual signal processing which is used in the steering tool is as follows: Since $\phi = \epsilon - \delta$ then $$\tan \phi = \frac{\tan \epsilon - \tan \gamma}{1 + \tan \epsilon \cdot \tan \cdot \gamma}$$

where $\tan \gamma = V_{BY}/V_{BX}$

Thus $$\tan \phi = \frac{V_{BX} \cdot \sin \epsilon - V_{BY} \cdot \cos \epsilon}{V_{BX} \cdot \cos \epsilon + V_{BY} \cdot \sin \epsilon}$$

Signals representing $V_{BY}$ and $V_{BX}$ are fed into a resolver synchro preset at angle $\epsilon$ by the operator. Thus, the output signals from this resolver synchro are $$V_{BY'} = V_{BY} \cos \epsilon - V_{BX} \sin \epsilon$$

and $$V_{BX'} = V_{BY} \sin \epsilon = V_{BX} \cos \epsilon$$

The signals $-V_{BY'}$ and $V_{BX'}$ are then fed into the resolver servo of the readout unit which will indicate a scale reading $r$ where $\tan r = -V_{BY'} / V_{BX'}$ thus, $$\tan r = \frac{V_{BX} \cdot \sin \epsilon - V_{BY} \cdot \cos \epsilon}{V_{BX} \cdot \cos \epsilon + V_{BY} \cdot \sin \epsilon}$$

Thus, the indicated readout angle $r$ is equal to the high side roll angle $\phi$.

While particular embodiments of the present invention have been shown and described, it is apparent that changes and modifications may be made without departing from this invention in its broader aspects, and therefore, the aim in the appended claims is to cover all such changes and modifications as fall within the true spirit and scope of this invention.

What is claimed is:

1. A method for determining the roll angle of a drill head in a borehole where the azimuth and inclination of the borehole and the magnetic dip at the borehole location are known, including the steps of: sensing with a tool the vector components of the earth's magnetic field along a set of tool fixed axes; providing signals indicative of such sensed vector components from the tool location to a remote location; modifying such signals indicative of sensed vector components by vectorially rotating such vector indicative signals through an angle that is a function of the known azimuth, inclination, and magnetic dip for providing the roll angle of the drill head.

2. The method of claim 1 and further including sensing the vector components in two of three tool fixed axes, the principal axis being transverse to the primary tool axis, such primary tool axis being aligned with the borehole axis at the tool location.

3. The method according to claim 2 and further including modifying such signals indicative of sensed vector components through vectorial rotation to relate such components to the earth's magnetic field components in principal axes rotated from magnetic north by the known azimuth angle of the borehole and from the vertical by the known inclination of the borehole.

4. The method according to claim 1 and further including, detecting signals at the earth's surface from the location of the drill head, which signals are representative of an angle in terms of the sensed components of magnetic field strength.

5. The method of claim 4 and further including modifying such signals representative of an angle through vectorial rotation to relate by predetermined data representing a high side roll angle parameter.

6. The method of claim 4 and further including modifying such signals representative of an angle through vectorial rotation by predetermined data representing a magnetic roll angle parameter.

7. The method of claim 1 and further including continuously indicating the roll angle of the drill head during a drilling run for the purpose of steering the drill head in the borehole.

* * * * *